United States Patent [19]

Schmidt

[11] 4,253,261

[45] Mar. 3, 1981

[54] REVOLVER

[76] Inventor: Friedrich Schmidt, 5904 Signal Hill Rd., Mechanicsville, Va. 23111

[21] Appl. No.: 61,544

[22] Filed: Jul. 27, 1979

[51] Int. Cl.[3] ..... F41C 1/00

[52] U.S. Cl. ..... 42/59

[58] Field of Search ..... 42/59

[56] References Cited

U.S. PATENT DOCUMENTS

| | | | |
|---|---|---|---|
| 756,182 | 3/1904 | Novak | 42/59 |
| 844,671 | 2/1907 | Garner | 42/59 |
| 913,756 | 3/1909 | McCarty | 42/59 |
| 1,904,730 | 4/1933 | Harrington | 42/59 |
| 3,046,842 | 7/1962 | Sergay | 42/59 |
| 3,136,084 | 6/1964 | Charron | 42/59 |
| 3,145,495 | 8/1964 | Katz et al. | 42/59 |
| 3,176,422 | 4/1965 | Harris | 42/59 |

*Primary Examiner*—Charles T. Jordan

*Attorney, Agent, or Firm*—Griffin, Branigan & Butler

[57] ABSTRACT

An improved revolver with a reduced barrel/cylinder gap (34) employs cylinder-chamber passages (54) through which bullets travel on route to the barrel bore (62) having diameters which are at least 0.005 inch greater than the diameter of the bullets. In this revolver the forcing cone (41) of the barrel bore (62) is at least one-half inch long and has a large-end diameter which is 0.025 to 0.035 inch larger than the bullet diameter. The cylinder/barrel gap (34) is less than 0.004 inch.

9 Claims, 7 Drawing Figures

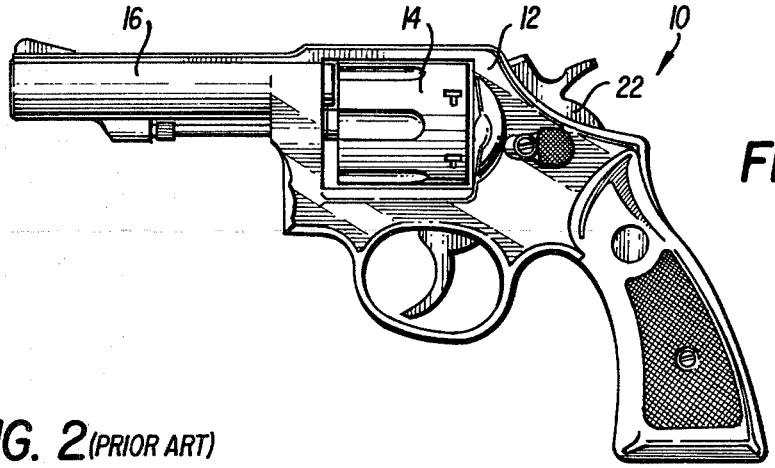
FIG. 1 (PRIOR ART)
FIG. 2 (PRIOR ART)
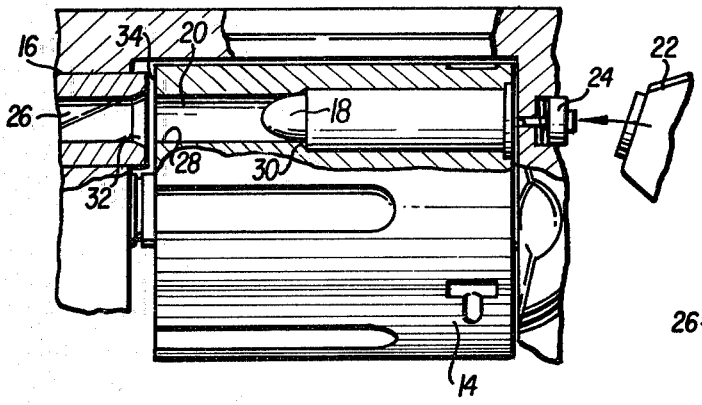
FIG. 3 (PRIOR ART)
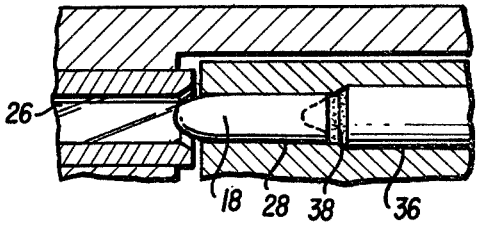
FIG. 4
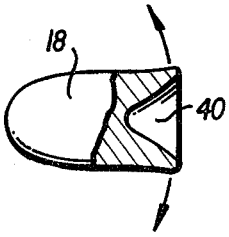
FIG. 6
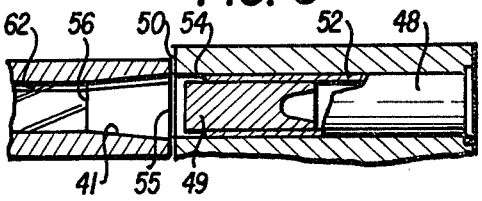
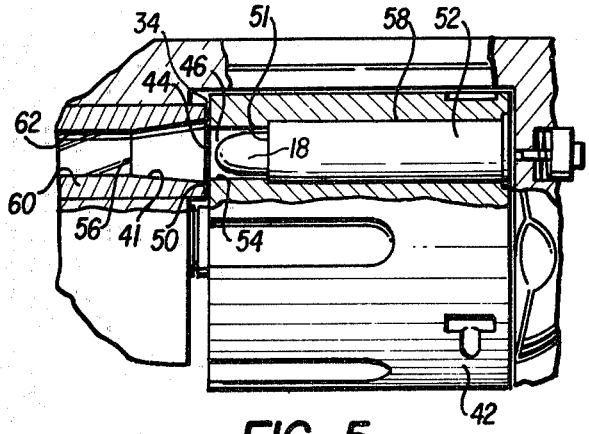
FIG. 5
FIG. 7
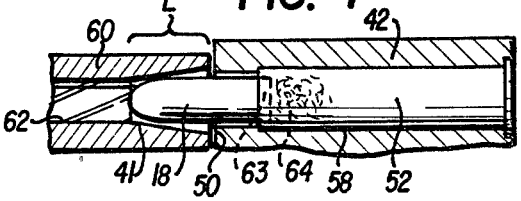

REVOLVER

BACKGROUND OF THE INVENTION

This invention relates broadly to the art of guns and more particularly to revolvers, especially those fired repeatedly for accuracy, such as at police practical courses and the like.

A problem with prior art revolvers involves the area between the cylinder and the barrel; namely, the barrel/cylinder gap. The reason that the barrel/cylinder gap is necessary is to allow clearance for the cylinder from the barrel so that the cylinder can be automatically rotated.

One aspect of this problem involves "spitting" from the gap. That is, powder and minute pieces of lead are expelled from the gap by pressure built up behind a bullet once the bullet passes the gap. This "spitting" has several negative results. For example, it sometimes irritates, or otherwise disturbs, skin, eyes, clothing, etc. located close by and it actually "eats away" at portions of the gun's frame. With respect to such "spitting" eating away portions of the frame, reference is made to U.S. Pat. No. 3,136,084 of Charron which employs a special hard material adjacent to the gap for increased stength and endurance of the gun.

Another aspect of the problem involves a loss of expanding gas from the gap which causes a loss of fire power.

These aspects of the problem are generally increased in intensity by a larger gap, and decreased in intensity by a smaller gap.

Thus, it is an object of this invention to provide a revolver which has a reduced barrel/cylinder gap to thereby decrease the amount of "spitting", and the loss of gas pressure of the revolver.

It is another object of this invention to provide a particular cylinder-chamber and barrel-bore arrangement which allows the reduction of the barrel/cylinder gap.

It is yet another object of this invention to provide a cylinder-chamber and barrel-bore arrangement for a revolver which produces a reduced recoil in comparison with most other similar revolvers.

SUMMARY OF THE INVENTION

According to principles of this invention, a revolver's cylinder chambers have bullet passages which are at least 0.005 inch larger than the bullets which will travel therethrough. In addition, the bore of the barrel has a forcing cone which is at least ½ inch long and has a diameter at its larger-diameter end which is 0.025 to 0.035 inch greater than the diameter of the bullet.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is a side view of a prior-art revolver which can be modified in accordance with this invention;

FIG. 2 is a side view of a portion of the revolver of FIG. 1 cut away to show a single-cylinder chamber and the rear end of a barrel bore, as well as associated structure;

FIG. 3 is a simplified view similar to FIG. 2 showing the bullet of FIG. 2 shot into the barrel;

FIG. 4 is a simplified view of the bullet of FIG. 3;

FIG. 5 is a cut-away view similar to FIG. 2 showing a cylinder chamber and the rear end of a barrel modified in accordance with this invention;

FIG. 6 is a simplified view similar to FIG. 5 but showing an alternate embodiment of the modifications of this invention; and FIG. 7 is a simplified view similar to FIG. 5 showing the bullet of FIG. 5 being shot from the cylinder chamber into the rear end of the barrel bore.

DESCRIPTION OF THE PREFERRED EMBODIMENT

A prior-art revolver 10 of FIG. 1 includes a main frame 12, a cylinder 14 mounted for revolving in the main frame 12, and a barrel 16 screwed into the main frame 12 for receiving bullets shot from the cylinder 14. The cylinder 14 automatically revolves one increment each time a bullet 18 (FIG. 2) is shot from a cylinder chamber 20 by means of a hammer 22 and a firing pin 24 to bring another cylinder chamber 20 into registration with a barrel bore 26.

In revolvers of the prior art the cylinder chambers 20 each includes a throat 28 which is approximately the same size in cross-section as, or perhaps .001 inch larger than, the bullets 18 being shot and it includes a cylinder forcing cone 30. The barrel 16 includes a barrel forcing cone 32 leading into the barrel bore 26. The cylinder forcing cones 30 reduce the diameter of the cylinder chambers 20 so that the throats 28, through which the bullets 18 will pass, are approximately the same size as the bullets. The barrel forcing cone 32 insures that the bullets 18 are forced into the barrel bore 26, which is approximately the same size in diameter as the bullets. The barrel bore 26 includes rifling (not shown) which rotates the bullets 18 upon their being thereby engaged. In the prior art, the purpose of the throats 28 is to line up, or aim, the travel of the bullets 18 into the barrel bore 26 to insure a smooth transition of the bullets' travel between the cylinder chambers 20 and the barrel bore 26. The barrel forcing cone 32 has a large diameter at its rearmost end which is approximately 0.010 inch larger than the bullets and it is approximately ⅛ inch long along the axis of the barrel 16.

A barrel cylinder gap 34 is left between the rear-most end of the barrel 16 and the front end of the cylinder 14 so as to allow freedom for revolving movement of the cylinder 14. The gap 34, for prior-art revolvers is in the range from 0.004 to 0.006 inch, when the revolver has not been fired. In this respect, when the revolver is fired repeatedly in a relatively short length of time, its cylinder 14 gets hot and, therefore, expands. This expansion reduces the gap 34. For this reason, the gap 34 has a minimum size which is determined by expansion of the cylinder 14 and it has a maximum size which, of course, is determined by how much "spitting" and "gas loss" is acceptable.

With regard to the cylinder 14 getting hot, and with regard to "spitting", when a bullet 18 is discharged from its cartridge, or shell, 36, (as is illustrated in FIG. 3), and passes the gap 34, it impacts upon the forcing cone 32, and rifling (not shown) of the barrel bore 26. At this point, the forward motion of the bullet 18 is slowed and expanding gases 38 tend to expand the rear end of the bullet 18 as is illustrated by arrows in FIG. 4. In this regard, the rear end of the bullet 18 often has a hollow cone 40 therein which enhances this expansion. Expansion of the bullet 18 causes undue friction between the bullet 18 and the cylinder throat 28 which both heats up the cylinder 14 and leaves lead residue within the throat 28. The heating, of course, expands the cylinder, thereby requiring that the gap be unduly large. The lead residue is often "spitted" with powder particles, thereby increasing the destructive nature of the spitting.

Another adverse effect which is thought to be derived from this bullet expansion is increased recoil because of friction resistance to forward motion of the bullet. Further, it is thought that this friction resistance also causes a loss in bullet speed.

The modifications of my invention are depicted in FIGS. 5–7. The basic objective of my invention is to reduce the gap 34 from 0.004 to 0.006 inch to below 0.004 inch and, in particular to around 0.002 inch. However, in accomplishing this, my structure also, I believe, increases bullet speed, and decreases recoil. Basically, I am able to reduce the gap 34 by eliminating the chamber throats 28 (FIGS. 2 and 3) and by providing a modified barrel forcing cone 41 (FIGS. 5–7).

The chamber throats 28 are eliminated in two ways. Firstly, the cylinder 14 (FIGS. 1–3) is made shorter to produce a modified cylinder 42 (FIGS. 5 and 7) whereby the front end 44 of the cylinder 42 is very close to the front nose 46 of the bullets 18. In this respect, if only "wadcutter" style target ammunition 48, (short, blunt bullets 49, approximately 0.665 inch in length for example ) as is depicted in FIG. 6, is to be fired, the cylinder 42 can be made extremely short with the front end 50 thereof being just in front of the front end 51 of the ammunition shells 52, approximately 1.095 inch in length for example. To provide a reference, cylinders for most 38 caliber revolvers are around 1.560 inches in length. However, a revolver's cylinder which I modified in accordance with my invention is only 1.220 inches long for shooting wadcutter ammunition. Although I have not done it, I believe that the cylinder could actually be shortened to be around 1.095 inches long for shooting wadcutter ammunition. For round-nose ammunition the length of the cylinder when practicing my invention is around 1.404 inches. For a revolver made to shoot only wadcutter ammunition, passage 54 is almost nonexistent. This invention works particularly well for wadcutter style ammunition, however, it also works for other types of ammunition as well.

In addition to making the cylinder 42 shorter than standard cylinders 14, the cylinder throats are eliminated from the chambers 42 such that there are merely passages 54 extending from the ends 51 of the shells 52 to the front end 50 of the cylinder 42. The diameter of the passages 54 are 0.005 to 0.020 inch larger than the diameter of the bullets 18 at all cross-sectional areas, which is quite different from the prior-art cylinder throats which are approximately the same size as, or 0.001 inch larger than, the bullets. This increased diameter minimizes, and perhaps eliminates, contact between the sides of bullets 18 and the passages 54.

An additional difference of the structure of this invention over the prior-art structure resides in the length of, and greater diameter of, the barrel forcing chamber 41. In this respect, at its greatest diameter 55, the rear end thereof, it is 0.025 to 0.035 inch greater than the diameter of the bullets 18 which are to pass therethrough. Its smallest diameter 56 is approximately the same diameter as that of the bullets 18. Its length L is from $\frac{1}{2}$ inch to $\frac{5}{8}$ inches. In contrast to these dimensions, prior-art barrel forcing cones have diameters of around 0.010 inches greater than the bullets at their greatest diameters and are from $\frac{1}{8}$ to $\frac{3}{8}$ inch in length. Thus, the barrel forcing cone of this invention is generally much longer and more gradually sloped than barrel forcing cones in the prior art. It should be noted that the passages 54 can be slightly smaller than the remainder of the cylinder chambers 58 in which the shells 52 are located, however, they can also be of uniform size therewith. However, they cannot be less than 0.005 inch (preferably between 0.005 and 0.010 ) larger than the bullet, and should be as short as possible. Although the passages 54 could be as large as 0.020 inch larger than the bullet, it is preferable that it be less than .010 larger to control bullets which, for some reason do not go straight.

In operation, when a bullet 18 is fired from its cartridge 52, as is depicted in FIG. 7, it enters the forcing cone 41 of the barrel 60 while its rear end 62 is still in the shell 52 and makes contact therewith. The barrel forcing cone, and rifling of the bore 62, upon first contact with the bullet 18, cause momentary impulsive shock to the bullet's forward motion. At this impulsive shock expanding gases 64 in the shell 52 try to expand the rear end 63 of the bullet 18, however, the bullet 18 is prevented from expanding by the brass of which shell 52 is made. Because the cylinder 42 is so short, the bullet 18 leaves the cylinder 42 without having made substantial contact with the cylinder chamber 58. Thus, the cylinder chamber 58 is not subjected to frictional heating between the bullet and the cylinder and the cylinder 42 does not expand unduly, as do most prior art cylinders. For this reason, the barrel/cylinder gap 34 is made to be a maximum of 0.0002 inch, which is quite a bit smaller than is employed in the prior art.

The combination described herein was tested with a Smith & Wesson 38 caliber revolver which was modified to have the features of this invention (cylinder length—1.220 inch; passage—0.005 inch larger than the bullet; and barrel forcing cone—between $\frac{1}{2}$ inch and $\frac{5}{8}$ inches). Wadcutter ammunition, 148 grain, was fired therewith. Forty rounds were fired holding a tissue one inch from the cylinder, draped on both sides of the cylinder. Thereafter the tissue was observed and there was no indication of spitting to the naked eye. With a similar pistol which had not been modified in accordance with this invention, such a procedure produces visible marks on a tissue. In addition, a Smith & Wesson model 10 revolver modified in accordance with this invention was fired by a police sharpshooter for 1,000 rounds, with 38 caliber, 148 grain Wadcutter ammunition. This pistol was then examined for lead fouling and no evidence thereof was found. In addition, the sharpshooter reported that the recoil thereof appeared to be less than for normal pistols and that he consistently scored better therewith than he was with other pistols.

It will be understood by those skilled in the art that the combination of features described herein provides extremely beneficial and unexpected, but yet highly desirable results. In this respect, I have set forth above my opinion as to why the structural features of my invention provide the above described results, however, I am not, in all cases, sure that my theories as to the causes are accurate.

While the invention has been particularly shown and described with reference to preferred embodiments, it will be understood by those skilled in the art that various changes in form and detail may be made therein without departing from the spirit and scope of the invention.

I claim:

1. In a revolver comprising:

a frame;

a cylinder rotatable in the frame, said cylinder having parallel elongated, round-cross-sectioned, cylinder chambers therein for receiving bullet cartridges at first ends thereof and expelling bullets from second end thereof when said chambers are in a firing position;

a barrel mounted in said frame with an end thereof being held in close proximity to the second end of each of said chambers when they are in said firing position, said barrel defining a bore for receiving said bullets expelled from said second ends of said cylinder chambers, guiding said bullets along a path and finally expelling said bullets;

the improvement wherein:

passages of said cylinder chambers through which said bullets travel on route to said barrel bore have a diameter which is at least 0.005 inch larger than the bullets which will travel therethrough;

the bore of the barrel has a forcing cone which is at least $\frac{1}{2}$ inch long; and the gap between said barrel and said cylinder is less than 0.004 inch.

2. In a revolver as in claim 1 wherein said barrel forcing cone is between $\frac{1}{2}$ inch and $\frac{5}{8}$ inch long.

3. In a revolver as in claim 2 wherein said cylinder chamber is of uniform diameter throughout.

4. A revolver as in claim 1 or 2 wherein said gap is approximately 0.002 inch.

5. A revolver as in claim 4 wherein said cylinder chamber is of uniform diameter throughout.

6. A revolver as in claim 1 or 2, in which a mouth of said forcing cone is from 0.025 inch to 0.035 inch larger in diameter than the diameter of said bullets.

7. A revolver as in claim 1 or 2 in which said cylinder passages are between 0.005 and 0.020 inch larger than the bullets which will travel therethrough.

8. A revolver as in claims 1 or 2 in which said cylinder passages are between 0.005 and 0.010 inch larger than the bullet which will travel therethrough.

9. A revolver as in claim 1 or 2 wherein the length of said cylinder chambers, the width of said gap, and the size of said barrel forcing cone are proportioned for producing contact between the barrel forcing cone and a forward portion of bullets while rear portions of said bullets still extend into shells from which they are shot.

* * * * *

UNITED STATES PATENT AND TRADEMARK OFFICE

CERTIFICATE OF CORRECTION

PATENT NO. : 4,253,261

DATED : March 3, 1981

INVENTOR(S) : Friedrich Schmidt

It is certified that error appears in the above—identified patent and that said Letters Patent is hereby corrected as shown below:

Column 4, line 40, change "0.0002 inch" to -- 0.002 inch --.

Signed and Sealed this

*Second* Day of *June 1981*

[SEAL]

*Attest:*

RENE D. TEGTMEYER

*Attesting Officer*

*Acting Commissioner of Patents and Trademarks*